US006933693B2

(12) United States Patent
Schuchmann

(10) Patent No.: US 6,933,693 B2
(45) Date of Patent: Aug. 23, 2005

(54) METHOD AND APPARATUS OF DETECTING DISTURBANCES IN A CENTRIFUGAL PUMP

(75) Inventor: Russell P. Schuchmann, Grinnell, IA (US)

(73) Assignee: Eaton Corporation, Cleveland, OH (US)

( * ) Notice: Subject to any disclaimer, the term of this patent is extended or adjusted under 35 U.S.C. 154(b) by 66 days.

(21) Appl. No.: 10/065,688

(22) Filed: Nov. 8, 2002

(65) Prior Publication Data

US 2004/0090197 A1 May 13, 2004

(51) Int. Cl.[7] ..... H02P 7/00; G01R 23/16; F04B 49/06

(52) U.S. Cl. ..... 318/432; 318/445; 318/438; 318/490; 702/76; 417/45; 417/44.1; 324/76.19; 324/76.22

(58) Field of Search ..... 318/445, 432, 318/438, 729, 490; 361/22, 23, 30; 702/76, 44, 60, 61, 64; 324/522, 772, 76.21, 76.19, 76.22; 417/44.11, 45, 44.1

(56) References Cited

U.S. PATENT DOCUMENTS

| | | | | | |
|---|---|---|---|---|---|
| 3,839,628 | A | * | 10/1974 | Higgins et al. | 702/60 |
| 4,060,716 | A | * | 11/1977 | Pekrul et al. | 702/184 |
| 4,744,041 | A | * | 5/1988 | Strunk et al. | 702/84 |
| 4,965,513 | A | * | 10/1990 | Haynes et al. | 324/772 |
| 5,234,319 | A | * | 8/1993 | Wilder | 417/40 |
| 5,479,824 | A | * | 1/1996 | Torres | 73/602 |
| 5,519,337 | A | * | 5/1996 | Casada | 324/772 |
| 5,671,635 | A | * | 9/1997 | Nadeau et al. | 73/168 |
| 5,726,905 | A | * | 3/1998 | Yazici et al. | 702/38 |
| 5,739,698 | A | * | 4/1998 | Bowers et al. | 324/772 |
| 5,754,450 | A | * | 5/1998 | Solomon et al. | 702/35 |
| 5,930,092 | A | * | 7/1999 | Nystrom | 361/30 |
| 6,199,023 | B1 | * | 3/2001 | Kliman | 702/67 |
| 6,260,004 | B1 | * | 7/2001 | Hays et al. | 702/183 |
| 6,267,559 | B1 | * | 7/2001 | Mossman et al. | 417/44.1 |
| 6,449,567 | B1 | * | 9/2002 | Desai et al. | 702/58 |
| 6,507,797 | B1 | * | 1/2003 | Kliman et al. | 702/75 |
| 6,553,334 | B2 | * | 4/2003 | Gross et al. | 702/183 |
| 6,709,240 | B1 | * | 3/2004 | Schmalz et al. | 417/44.11 |

FOREIGN PATENT DOCUMENTS

| | | | | |
|---|---|---|---|---|
| JP | 59230492 | A | * 12/1984 | H02P/7/00 |
| JP | 11311591 | A | * 11/1999 | G01M/19/00 |

OTHER PUBLICATIONS

Wallace, et al., "Pump Reliability Improvements through Effective Seals and Coupling Management", Proceedings of 15th International Pump Users Symposium, Mar. 3–5, 1998.

Casada, D., "Examination of Pump Failure Data in the Nucleur Power Industry", Oak Ridge National Laboratory, Proceedings of the Fourth NRC/ASME Symposium on Valve and Pump Testing, Jul. 1996.

(Continued)

*Primary Examiner*—David Martin
*Assistant Examiner*—Patrick Miller
(74) *Attorney, Agent, or Firm*—Ziolkowski Patent Solutions Group, SC

(57) ABSTRACT

The present invention is directed to a centrifugal pump wherein voltage and current data are detected from voltage and current sensors in the motor controller of a pump motor. A power signal is then generated from the voltage and current data and spectrally analyzed to determine the presence of unwanted harmonics which are indicative of mechanical disturbances in the pump. As such, anomalies resulting from mechanical interference may be detected and a warning flag provided without additional transducers and other instruments on the motor or pump.

18 Claims, 2 Drawing Sheets

OTHER PUBLICATIONS

Flach, et al., "Analyzing Unacceptable Seal Performance", Proceedings of 15$^{th}$ International Pump Users Symposium, Mar. 3–5, 1998.

Urwin, et al., "Life Cycle Costs for Chemical Process Pumps", Chemical Engineering, Jan. 1998.

Wilkinson, et al., "Cavitation Effects on Pump Thrust Leading to Bearing Failures", Proceedings of 15$^{th}$ International Pump Users Symposium, Mar. 3–5, 1998.

Casada, D., "Using the Motor to Monitor Pump Conditions", Oak Ridge National Laboratory, Date Unknown (but prior to 1999).

Burstein, et al., "Reactor Coolant Pump Testing Using Motor Current Signature Analysis", Oak Ridge National Laboratory, Date Unknown (but prior to 1999).

Kenull, et al., "Diagnostics of Submersible Motor Pumps by Non–Stationary Signals in Motor Current", The 1997 ASME Fluids Engineering Division, Summer Meeting, Jun. 22–26, 1997.

* cited by examiner

METHOD AND APPARATUS OF DETECTING DISTURBANCES IN A CENTRIFUGAL PUMP

BACKGROUND OF INVENTION

The present invention relates generally to centrifugal pumps, and more particularly, to a method and apparatus of detecting torsional disturbances or alternately mechanical disturbances that cause displacement of the motor's rotor in a centrifugal pump assembly using voltage and current data acquired from voltage and current sensors in the pump motor controller assembly.

Submersible types of centrifugal motor pumps are used for a number of applications, such as drinking water supply, irrigation, and de-watering as well as in offshore applications. In these applications and others, the motor as well as the pump may be submerged and installed in deep wells down to several thousand meters. Moreover, motor power can exceed 2,000 kW and voltages over 10,000 V. As a result of the remote location of these pumps, condition monitoring and detection of defects at an early state are often difficult. For example, sensors for shaft vibration often fall or are not practical as they cannot efficiently withstand high ambient water pressure. Additionally, signal cables may be used to translate signals to a surface monitoring device but the cables are often damaged during pump installation to a deep well. As a result, most submersible pumps work with an overload switch as the only protection mechanism. These overload protection devices normally detect overload, underload, or phase differences. As power consumption of the pumps change widely with operation point, the pump protectors have to be adjusted rather insensitively so that small changes in motor current caused, for example, by worn out bearings are not detected.

Mechanical disturbances or interference in motor/centrifugal pump assemblies may be caused by several conditions. For example, severe bearing deterioration may result in binding of deteriorated balls of the bearing or of rubbing in the area between wear rings and the pump rotor. In close-coupled pumps touchdown of a motor rotor to the stator may occur resulting in mechanical disturbances. Shaft misalignment or bent shafts may also create interference through vibration and torque ripple. Debris which may be lodged in or around the pump impeller may also create mechanical interference. Moreover, loose impeller or unstable foundation may also create interference and disrupt proper operation of the pump.

Because of the location of the submersible pump during operation, it is typically difficult to detect the onset of a mechanical disturbance. Some systems have been developed to detect the early onset of a mechanical failure using extra instrumentation or separate modules connected to cables placed in the deep well with the pump. This additional instrumentation, however, adds to the cost of the pump and damage to the cables often occurs when placed in a deep well.

Centrifugal pumps used in process industries such as refineries are often critical to the process. Pump failure may result in severe economic loss due to unscheduled plant shutdown and the attendant cleanup and restart required after unscheduled shutdown. These critical pumps are sometimes fitted with vibration monitoring equipment, or are subject to periodic testing with portable equipment to try to predict developing faults. However, the installation cost of in-place monitoring is high and the skilled labor associated with periodic testing is costly.

It would therefore be desirable to design a pump assembly wherein mechanical disturbances or interferences are quickly identified and detected without additional instrumentation in the pump.

SUMMARY OF INVENTION

The present invention is directed to a centrifugal pump wherein voltage and current data are detected from voltage and current sensors in the controller assembly for the pump motor. A power signal is then generated from the voltage and current data and spectrally analyzed to determine the presence of unwanted harmonics which are indicative of mechanical disturbances in the pump. As such, torque anomalies or displacements of the motor rotor resulting from mechanical interference may be detected and a warning or maintenance flag provided without additional transducers and other instruments on the motor or pump.

Accordingly, motor power is used to determine the presence of a mechanical interference in the pump, i.e. a misaligned shaft, impeller damage, and debris. Power is preferably determined from voltage and current data acquired from a three-phase motor. At initial setup of the pump assembly, a baseline signal is determined from the pump known to be operating in a normal, healthy condition. The baseline signal or data is then used for comparison with instantaneous power signals so that deviations from normal, healthy operation can be readily identified.

Voltage and current data are collected for a relatively short period of time such as one second and a corresponding power signal is then generated. The power signal is then analyzed with a fast Fourier transform (FFT) to locate discrete frequency peaks that are related to rotational frequency. The amount of second harmonic of power frequency expected due to the voltage and current unbalance is then estimated and used as a check on power quality. By comparing the transformed signal with the baseline signal, spectral peaks indicative of undesirable or unexpected harmonics may be readily identified. Once the peaks are located, the magnitude of the peaks is also observed as an indication of the magnitude of the mechanical disturbance. Preferably, a maintenance warning or flag is then provided to an operator or other technician so that, if needed, the pump may be shut down and repaired.

Therefore, in accordance with one aspect of the present invention, a motor control for a motor-driven pump is provided. A controller includes at least one voltage sensor and at least one current sensor and is configured to receive a voltage and a current signal of the pump in operation from the at least one voltage sensor and at least one current sensor. The controller is further configured to determine a power signal from the voltage signal and the current signal and generate a real-time spectrum analysis of the power signal. The controller is also configured to determine undesirable torque or motor rotor displacement conditions in the pump from the spectrum analysis.

In accordance with another aspect of the present invention, a computer readable storage medium having stored thereon a computer program to detect and signal mechanical anomalies in a motor-driven pump is provided. The computer program represents a set of instructions that when executed by a processor causes the processor to determine an instantaneous pump motor power signal from voltage and current data collected by one or more voltage and current sensors in the motor of the motor-driven pump. The set of instructions further causes the processor to signal process the instantaneous pump motor power signal and compare the processed signal to a pump motor power signal modeled from healthy operation of the pump motor. The computer program then determines whether harmonics of the instantaneous pump motor signal exceed a threshold and if so provides an external notification signaling the presence of mechanical anomalies in the pump.

In accordance with yet a further aspect of the present invention, a method of detecting mechanical anomalies in an operating centrifugal pump motor includes the step of capturing an operational model of a centrifugal pump motor assembly that is known to be operating properly. The method further includes the steps of generating a baseline power signal from the model and acquiring instantaneous voltage and current signals of the pump motor assembly from voltage and current sensors in the motor assembly. A real-power signal is then determined from the instantaneous voltage and current signals and analyzed to determine the presence of undesirable harmonics in the real-time power signal based on a comparison with the baseline power signal.

In accordance with another aspect of the present invention, an apparatus for detecting undesirable mechanical condition in a pump includes at least one voltage sensor and at least one current sensor. The apparatus also includes a processor configured to receive data from the sensors. The processor includes means for determining a power signal from the voltage and current data, means for generating a spectrum analysis of the power signal, and means for comparing the spectrum analysis to a spectrum analysis of a baseline power signal. The processor also includes means for determining undesirable harmonics in the power signal indicative of mechanical disturbances in the pump.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

The present invention is related to the detection of abnormal conditions as a result of mechanical interference in a centrifugal pump. However, the present invention is equivalently applicable to the detection of undesirable conditions in other types of motor-driven pumps. Abnormal conditions or disturbances include but are not limited to interference caused by impeller damage, shaft misalignment, lodged debris, seal failure, bearing failure, and ring wear.

Figure 1:
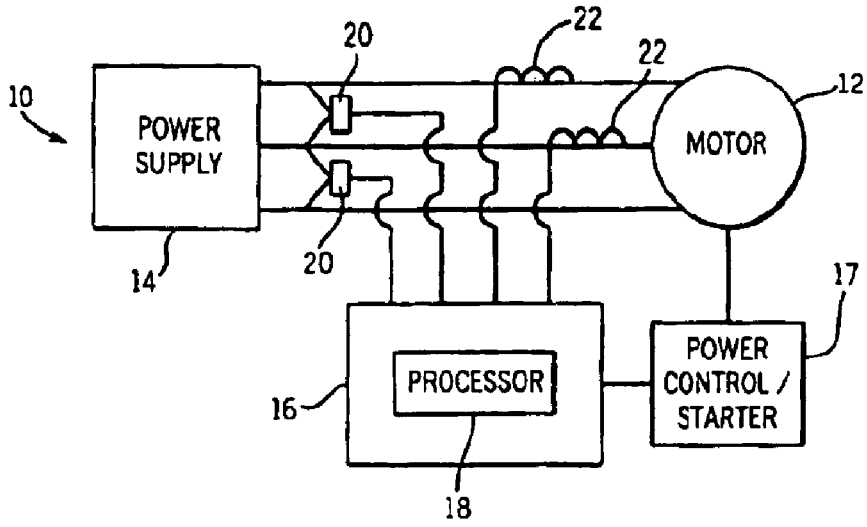
FIG. 1 is a schematic representation of a motor assembly for a centrifugal pump.

Referring now to FIG. 1, a motor assembly such as an induction motor for a centrifugal pump is shown. Motor assembly 10 includes a motor 12 that receives power from a power supply 14. The assembly also includes a controller 16 used to monitor as well as control operation of the motor in response to operator inputs or motor overloads. The motor and controller assembly typically include either contacts or electronic devices as a power control 17 in series with the motor supply to control power to the motor. These contacts or electronic devices can then be used to acquire data for the detection of abnormal conditions. Also, typically the power control is incorporated in the motor starter. The controller 16 includes a processor 18 that, as will be described in greater detail with respect to FIGS. 2–3, implements an algorithm to determine the presence of unwanted mechanical conditions in the centrifugal pump based on voltage and current data. Motor assembly 10 further includes a pair of voltage sensors 20 and a pair of current sensors 22. As is generally known, voltage and current data may be acquired from only two of the phases of a three-phase motor as voltage and current data for the third phase may be extrapolated from the voltage and current data of the monitored two phases. While the present invention will be described with respect to a three-phase motor, the present invention is equivalently applicable to a two-phase and a single-phase motor.

Figure 2:
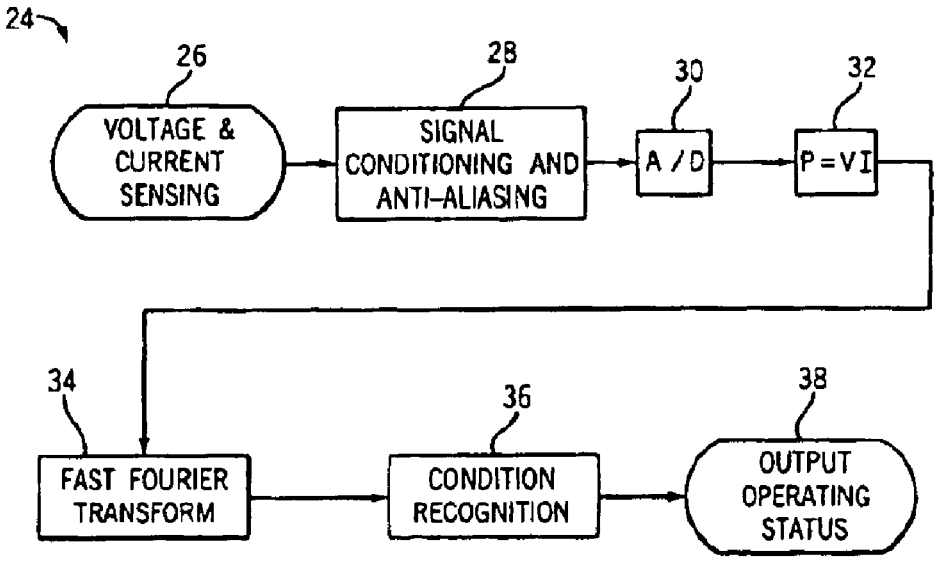
FIG. 2 is a flow chart generally setting forth the steps of detecting abnormal conditions in a centrifugal pump in accordance with the present invention.

Referring now to FIG. 2, a general overview of detecting and determining the presence of unwanted mechanical conditions in a centrifugal pump is shown. The process 24 employs an FFT to generate a spectrum analysis of a power signal based on voltage and current data acquired from sensors in the pump motor. The process of detecting an unwanted mechanical condition in a centrifugal pump using an FFT begins with the acquisition of voltage and current data 26 using voltage and current sensors present in the motor assembly. By acquiring the voltage and current data directly from voltage sensors in the motor, it is unnecessary to incorporate additional instrumentation to acquire the voltage and current data as the motor typically includes voltage and current sensors. Once the voltage and current signals are acquired, the signals are conditioned at 28. Signal conditioning the voltage and current signals also includes anti-aliasing of the signals. Once the voltage and current signals are properly conditioned, they are input into an analog-to-digital converter 30 for sampling. From the sampled voltage and current signals, a power signal or calculation is determined at 32. The power signal is determined by multiplying the voltage values and the current values. As a result, a power signal representing power in the motor as a function of time may be readily generated. The calculated power signal then undergoes an FFT at 34 to generate a frequency spectrum. By applying an FFT to the power signal, a frequency spectrum may be generated and compared to a baseline frequency spectrum. Based on this comparison 36, an output signal signaling the presence of undesirable mechanical conditions may be output at 38. The output may take a number of forms including audio and visual warnings and shut down of the pump.

Figure 3:
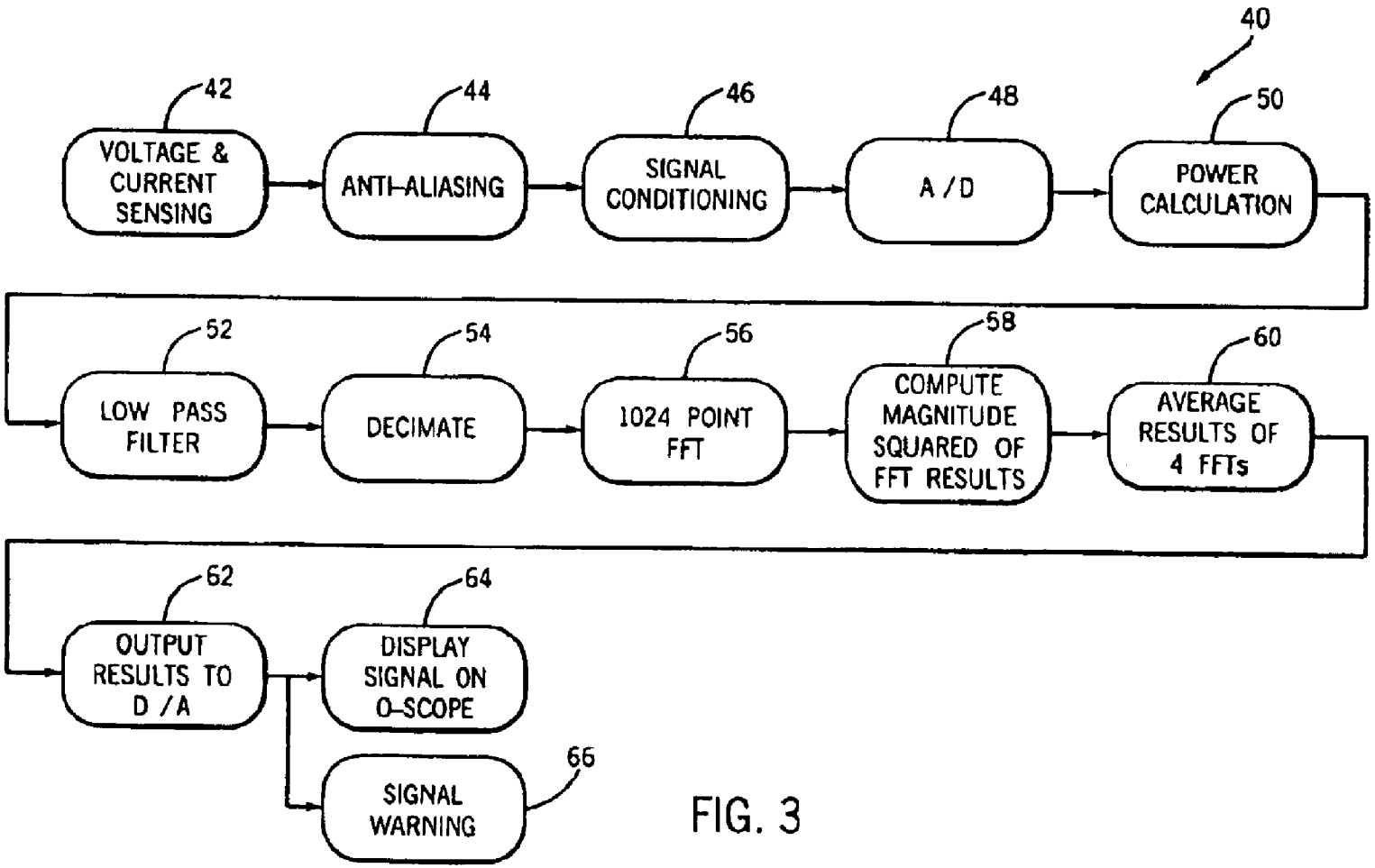
FIG. 3 is a flow chart setting forth in greater detail that shown in FIG. 2.

Referring now to FIG. 3, the specifics of a disturbance detection scheme utilizing an FFT are shown. The algorithm or process 40 provides an efficient mechanism to calculate the FFT of motor power and compare critical frequencies to thresholds established during setup when the pump was known to be in good mechanical condition and operating at or near its best efficiency point. These thresholds or baseline data are acquired during initial setup of the pump motor under a variety of normal operating conditions so that nuances relative to each pump and its associated piping are taken into account when determining the basepoint of operation. Simply, each pump is modeled to determine a baseline data of operation so that variances over time can be readily identified relative to the known healthy and normal operation of the pump.

As previously described, voltage and current data are acquired from voltage and current sensors in the motor starter of the pump motor. Specifically, two line-to-line voltages with respect to a common node and line currents for those two lines of a three-phase induction motor are acquired at 42 and considered input to the detection algorithm. The voltage and current data are then input to an anti-aliasing filter at 44 that provides at least 40 db of attenuation at a frequency that is one-half the sampling rate. It is recommended that the anti-aliasing filter have less than one db of pass-band ripple, The anti-aliased signals are then conditioned at 46. The conditioned signals are then input to an analog-to-digital converter and sampled at a sampling rate of approximately 5 kHz, the rate chosen preferably to incorporate an integral number of cycles of the power line within the sample length. The sampled signals are then input to a power calculation means 50.

The power calculation is preferably a three-phase calculation done "on the fly". That is, the power of the pump motor is determined in real-time as the data is acquired. The power is determined by treating one of the motor terminals as a common node and then multiplying the line-to-line voltages with respect to that node by the respective line current. Following the power calculation, the power signals are filtered in real-time at 52 and decimated to a 1024 point dataset which is stored in memory to be used by the FFT at 54. Since the power has a relatively large average value relative to the components of interest, the average value is removed from the data set at 54 to greatly reduce the numerical range that must be handled in the subsequent processing. This is done by summing the values over the data set and subtracting the average value from each power point. In order to avoid gathering data during power transients or startup conditions, the average value of the first half of the data set is compared to that of the second half and required to be less than a specified value. Otherwise, the data set is discarded. As will be described in greater detail below, a steady state analysis is performed to ensure that the filter output has reached the average value before the start of data acquisition.

Operation of the system is described in the following section using an example based on a 60 Hz power line frequency. The sample sizes and sampling rates are oriented to faults that generate disturbances at the running speed of the motor. However it should be understood that other sample sizes, sampling rates and filtering characteristics can be selected to detect other disturbances such as bearing frequencies.

Filtering of the power signal is done at 52 by a sixth order low pass elliptic filter with a cutoff frequency of 120 Hz, pass-band ripple of less than one db, and attenuation of 60 db at 180 Hz. This filtering is required to eliminate aliasing when the data is decimated to the final sampling frequency. The cutoff frequency is chosen to permit sensing signals as high as 120 Hz, or about twice the running frequency of a two-pole motor operating on a 60 Hz line. Preferably, the data originally sampled at approximately 5 kHz is decimated at 54 by a factor of 14 to produce an effective sampling rate of about 357 Hz. This choice is based on several factors. For example, the data set for an efficient FFT must be of length to $2^n$ to produce a spectrum with quality definition. The spectral resolution must be sufficient to distinguish between leakage at the power frequency and its harmonics and signals related to the running speed of the motor. For example, for a two-pole motor, these are only separated by the slip frequency. Thus, it is desirable to have at least 0.4 Hz of spectral resolution, defined by:

$$\text{resolution}=Fs/Np \qquad \text{(Eqn. 1)},$$

where Fs is the sampling rate and Np is the number of points in the data set. For an Fs of 357 and an Np of 1024, the resolution is about 0.35 Hz. An additional factor to consider is avoiding loss of data resolution when executing a fixed point FFT. To do so, it is desirable to use a minimum data set length, consistent with other constraints. Finally, choosing a data set length that contains an integral number of line cycles improves spectral definition without the use of a window that would ultimately require additional multiply operations.

Referring again to FIG. 3, the decimated signal then undergoes a 1024 point FFT at 56. Preferably, a digital signal processor is used to apply the FFT and yields results and spectrum values that are the square of the actual amplitude of the signal. Since the square root operation is not trivial, the squared values are used in evaluating the spectrum 58. Because an FFT for a given data set will show some random variation and spectral amplitude when compared to FFTs from other data sets gathered under conditions that are nominally the same, it is preferable to diminish this randomness by averaging several FFTs together. As a result, preferably, four FFTs are averaged at 60 in accordance with the present invention. Because RAM may often be limited, the result of four separate FFTs prior to computing the average are not stored. That is, the same spectral buckets used to collect results for all four FFTs are used and an average is performed at the end. The average results of the four FFTs are then analyzed within a narrow band of frequencies about the running speed of the motor. Since running speed is a function of the number of motor poles, the frequency of interest, Fi, is centered around a frequency that is found as:

$$Fi=2*Fp/\text{Npoles} \qquad \text{(Eqn. 2)},$$

where Fp is the power line frequency and Npoles is the number of motor poles. The number of motor poles is a required parameter during system setup. The range of frequencies of interest about this point encompasses the normal range of slip frequencies for the motor. Particularly for motors with larger numbers of poles, it is also feasible to examine frequency ranges that represent low-order harmonics of the running speed that are generated by certain types of faults.

This frequency range has been empirically determined to be the range that "torsional" noise or harmonics are often found. The FFT data within the range are then input to a digital-to-analog converter at 62. The resultant signal can then be displayed on an oscilloscope for analysis by an observer at 64. A warning signal or alarm 66 may also be triggered based on detected unwanted harmonics in the power signal.

As indicated previously, the frequency spectrum of the real-time power signal is compared to a baseline signal to locate peaks in the spectrum in the frequency range of interest. Peaks may be identified by implementing the following algorithm:

$$\text{Peak}=A(N-1)<A(N)>A(N+1) \qquad \text{(Eqn. 3)},$$

where A(X) represents the amplitude of a given frequency bucket of the FFT, Spectral peaks are found by scanning the data and locating those points that exceed both the previous point and the following point. Only those peaks that exceed the baseline threshold are considered and preferably, the five largest peaks are selected for additional analysis. That is, the five largest peaks are selected by first zeroing the matrix into which the peaks are stored. Any location with a value of zero can be replaced by the value of the peak that is found. The frequency of the peak is saved into a second matrix in the corresponding position. If more than five peaks are found, the location of the minimum value of the matrix is found and, if the new peak is larger, it is written over the previous amplitude and frequency values. At the end of this procedure, the five highest peaks have been captured.

Because the area or frequencies of interest are often very near the power frequency or harmonics thereof, it is important to know whether the power frequency is well maintained. That is, the second harmonic power frequency found in the calculated power is generally much larger than any other spectral component. The location of this peak can then be used to determine whether the power frequency is within the bucket expected. If not, the comparison to baseline data is ignored. Since power line frequency is unlikely to be as much as one bucket width different from nominal for extended periods, the recommended approach is to warn an operator that the power line frequency has fallen outside the expected bucket and suspend other diagnostics during such times.

Peaks that are exact multiples of the power frequency are also ignored when comparing to the baseline data to record those peaks that exceed a threshold contained in the baseline data. For example, the frequency spectrum of the real-time power signal and the baseline may be displayed on a console such that an operator or technician can determine the presence of an unwanted torsional/mechanical condition based on visual detection of foreign peaks. Additionally, the frequency and magnitude relative to the threshold of peaks which exceed the threshold may also be displayed. Other indicators such as warning lights and audio warnings may also be implemented when peaks exceed the acceptable baseline on a persistent basis. That is, a two-level warning system may be implemented where peaks which narrowly exceed the baseline actuate a low priority warning light whereas peaks that are significantly higher than the baseline trigger an urgent alarm.

In a further embodiment of the present invention, the frequency of a peak may be isolated and referenced against empirical data detailing an association between defect and frequency. That is, based on the frequency corresponding to the peak and the presence of other harmonics of running speed, probable causes could be suggested. For example, based on frequency, a disturbance caused by a bearing failure could be distinguished from a disturbance caused by a broken impeller. Additionally, the aforementioned process could also be implemented to detect and distinguish failures corresponding to certain rotor or stator failures in the motor.

As previously described, a steady state analysis is implemented to ensure the integrity of the data acquisition. That is, the data is evaluated for a steady state operating condition by evaluating the average power of the first half of the data set versus that of the second half. For a steady state condition to be present, the average power for the two halves is required to be within one percent of each other. If a non-steady state condition is encountered the entire FFT data set is discarded and the process starts anew with a new group of four FFTs.

In accordance with another embodiment of the present invention, a computer readable storage medium having stored thereon a computer program to detect and signal mechanical anomalies in a motor-driven pump is provided. The computer program represents a set of instructions that when executed by a processor causes the processor to determine an instantaneous pump motor power signal from voltage and current data collected by one or more voltage and current sensors in the motor of the motor-driven pump. The set of instructions further causes the processor to signal process the instantaneous pump motor power signal and compare the processed signal to a pump motor power signal modeled from healthy operation of the pump motor. The computer program then determines whether harmonics of the instantaneous pump motor signal exceed a threshold and if so provides an external notification signaling the presence of mechanical anomalies in the pump.

In accordance with yet a further embodiment of the present invention, a method of detecting mechanical anomalies in an operating centrifugal pump motor includes the step of capturing key data during operation of a centrifugal pump motor assembly known to be operating properly. The method further includes the steps of generating a baseline power signal from the modeling and acquiring instantaneous voltage and current signals of the pump motor assembly from voltage and current sensors in the motor assembly. A real-power signal is then determined from the instantaneous voltage and current signals and analyzed to determine the presence of undesirable harmonics in the real-time power signal based on a comparison with the baseline power signal.

In accordance with another embodiment of the present invention, an apparatus for detecting undesirable mechanical condition in a pump includes at least one voltage sensor and at least one current sensor. The apparatus also includes a processor configured to receive data from the sensors. The processor includes means for determining a power signal from the voltage and current data means for generating a spectrum analysis of the power signal, and means for comprising the spectrum analysis to a spectrum analysis of a modeled power signal. The processor also includes means for determining undesirable harmonics in the power signal indication of mechanical disturbances in the pump.

The present invention has been described in terms of the preferred embodiment, and it is recognized that equivalents, alternatives, and modifications, aside from those expressly stated, are possible and within the scope of the appending claims.

What is claimed is:

1. A motor controller for a motor-driven pump, the controller having at least one voltage sensor and at least one current sensor and configured to:

receive a voltage and a current signal of the pump in operation from the at least one voltage sensor and the at least one current sensor;

determine a power signal from the voltage signal and the current signal;

generate a real-time spectrum analysis of the power signal;

determine undesirable torque conditions in the pump from the spectrum analysis; and automatically disable the pump if the undesirable torque condition exceeds a threshold.

2. The motor controller of claim 1 further configured to automatically provide an external indication of the undesirable torque condition in pump.

3. The motor controller of claim 1 further configured to apply an FFT to the power signal.

4. The motor controller of claim 1 further configured to band-pass filter the power signal.

5. The motor controller of claim 1 further configured to generate a model spectrum analysis of the pump during healthy operation and determine the undesirable torque condition in the pump by comparing the model to the real-time spectrum analysis.

6. The motor controller of claim 1 wherein the undesirable torque condition is defined by at least one of misalignment of the pump and mechanical interferences in the pump.

7. A computer readable storage medium having stored thereon a computer program to detect the signal mechanical anomalies in a motor-driven centrifugal pump and representing a set of instructions that when executed by a processor causes the processor to:

determine an instantaneous pump motor power signal from voltage and current data collected by one or more voltage and current sensors in a motor starter of the motor-driven centrifugal pump;

signal process the instantaneous pump motor power signal;

compare the processed instantaneous pump motor power signal to a pump motor power signal modeled during healthy operation of the pump motor;

if the processed instantaneous pump motor signal exceeds a threshold, provide an external notifications signaling mechanical anomalies in the pump; and differentiate noise from mechanical anomalies.

8. The computer readable storage medium of claim 7 wherein the set of instructions further causes the processor to perform a spectrum analysis on the instantaneous pump motor power signal.

9. The computer readable storage medium of claim 8 wherein the set of instructions further causes the processor to apply an FFT to the instantaneous pump motor power signal.

10. The computer readable storage medium of claim 8 wherein the set of instructions further causes the processor to input the instantaneous pump motor power signal to a band pass filter.

11. The computer readable storage medium of claim 7 wherein the instantaneous pump motor signal includes a three-phase power signal.

12. The computer readable storage medium of claim 7 wherein the set of instructions further causes the processor to display a spectrum analysis of the processed signal on a console.

13. A method of detecting mechanical anomalies in an operating centrifugal pump motor, the method comprising the steps of:

capturing an operational model of a centrifugal pump motor assembly known to be operating normally;

generating a baseline power signal from the modeling;

acquiring instantaneous voltage and current signals of the pump motor assembly from voltage and current sensors in the motor assembly;

determining a real-time power signal from the instantaneous voltage and current signals;

determining undesirable harmonics in the real-time power signal based on a comparison with the baseline power signal; and delineating between a transient condition in the pump and an undesirable mechanical condition based on several cycles of undesirable harmonics in the real-time power signal.

14. The method of claim 13 further comprising the step of determining the undesirable mechanical condition based on a presence of undesirable harmonics in the real-time power signal.

15. The method of claim 13 further comprising the steps of:

conditioning the instantaneous voltage and current signals;

digitizing the conditioned signals;

applying FFT to the power signal;

outputting the transformed signal to a digital-to-analog converter; and displaying analog signal.

16. The method of claim 13 wherein the step of acquiring instantaneous voltage and current signals includes the step of acquiring voltage and current data from at least two phases of the pump motor.

17. An apparatus for detecting undesirable torsional/mechanical conditions in a pump, the apparatus comprising:

at least one voltage sensor and at least one current sensor;

a processor configured to receive data from the at least one voltage sensor and the at least one current sensor, the processor having:

means for determining a power signal from the voltage and current data;

means for generating a spectrum analysis of the power signal;

means for comparing the spectrum analysis to a spectrum analysis of a modeled power signal;

means for determining undesirable harmonics indicative of mechanical disturbances in the pump from the comparison; and means for interrupting pump operation in response to an indication of a mechanical disturbance.

18. The apparatus of claim 17 further comprising means for displaying the spectrum analysis of the power signal on a console.

* * * * *

UNITED STATES PATENT AND TRADEMARK OFFICE

CERTIFICATE OF CORRECTION

PATENT NO. : 6,933,693 B2
DATED : August 23, 2005
INVENTOR(S) : Schuchmann

It is certified that error appears in the above-identified patent and that said Letters Patent is hereby corrected as shown below:

Column 8,
Line 55, insert -- the -- between “in” and “pump”;

Column 9,
Line 2, delete “the” and substitute therefore -- and --; and
Line 17, delete “notifications” and substitute therefore -- notification --.

Signed and Sealed this

Twenty-second Day of November, 2005

JON W. DUDAS
*Director of the United States Patent and Trademark Office*